US007069621B2

(12) United States Patent
Malek

(10) Patent No.: US 7,069,621 B2
(45) Date of Patent: Jul. 4, 2006

(54) BLOCK AND TACKLE SASH BALANCE SHOE

(75) Inventor: Neeman Malek, Lorraine (CA)

(73) Assignee: Pomeroy, Incorporated, Dubuque, IA (US)

( * ) Notice: Subject to any disclaimer, the term of this patent is extended or adjusted under 35 U.S.C. 154(b) by 49 days.

(21) Appl. No.: 10/626,847

(22) Filed: Jul. 23, 2003

(65) Prior Publication Data

US 2004/0163210 A1 Aug. 26, 2004

Related U.S. Application Data

(60) Provisional application No. 60/449,048, filed on Feb. 21, 2003.

(51) Int. Cl.
*E05F 1/00* (2006.01)

(52) U.S. Cl. ..... 16/194; 16/197; 49/445; 49/447

(58) Field of Classification Search ..... 16/193, 16/194, 196, 197; 49/445, 447
See application file for complete search history.

(56) References Cited

U.S. PATENT DOCUMENTS

| | | | | |
|---|---|---|---|---|
| 2,774,119 | A | 12/1956 | Osten | |
| 4,068,406 | A | 1/1978 | Wood | |
| 4,089,085 | A | 5/1978 | Fitzgibbon | |
| 4,190,930 | A | 3/1980 | Prosser | |
| 4,332,054 | A | 6/1982 | Paist et al. | |
| 4,610,108 | A | 9/1986 | Marshik | |
| 4,949,425 | A | 8/1990 | Dodson et al. | |
| 4,958,462 | A * | 9/1990 | Cross | 49/181 |
| 5,127,192 | A | 7/1992 | Cross | |
| 5,669,180 | A | 9/1997 | Maier | |
| 5,806,243 | A | 9/1998 | Prete et al. | |
| 5,873,199 | A * | 2/1999 | Meunier et al. | 49/181 |
| 6,151,832 | A | 11/2000 | Opielski et al. | |
| 6,332,288 | B1 | 12/2001 | Guillemet et al. | |
| 6,467,128 | B1 | 10/2002 | Damani | |
| 6,622,342 | B1 * | 9/2003 | Annes et al. | 16/197 |
| 6,840,011 | B1 * | 1/2005 | Thompson et al. | 49/181 |
| 2002/0129463 | A1 | 9/2002 | Newman | |
| 2003/0056320 | A1 * | 3/2003 | Newman et al. | 16/197 |

* cited by examiner

*Primary Examiner*—Chuck Y. Mah
*Assistant Examiner*—Michael J. Kyle
(74) *Attorney, Agent, or Firm*—Anthony P. Gangemi; Wiggin and Dana LLP

(57) ABSTRACT

A sash balance shoe housing designed to move along a window frame contains a spring attached to the housing and to a first pulley block that is movable along the housing, a second pulley block fixed against movement along the housing integrally molded with a brake mechanism bearing surface for supporting a cam designed to connect to a sash, and a cord attached by one end to one of the first pulley block and the second pulley block, wrapped around at least one pulley in each block and extending from the housing for attaching the other end to the window frame.

9 Claims, 8 Drawing Sheets

BLOCK AND TACKLE SASH BALANCE SHOE

This application claims the benefit of U.S. Provisional Application No. 60/449,048 filed Feb. 21, 2003.

BACKGROUND OF THE INVENTION

1. Field of the Invention

The invention pertains to sash balances, more particularly to a sash balance that is attached to a sash and contains a block and tackle and spring in a housing that moves with the sash as the housing moves along a window frame track and locks in the track when the sash is tilted out of the track.

2. Description of the Prior Art

Various brake shoe designs that attach to a sash by a pivot on the sash and include an element connected to the pivot that locks against a window frame track when the pivot is turned by the sash rotating out of the window frame, are hung from lifting devices that are mounted on the window frame above the shoe.

Damani, U.S. Pat. No. 6,467,128 describes a block and tackle in which the sash pivots on a bearing that is at the end of the cord that extends out of the bottom of the balance assembly housing.

In Prosser, U.S. Pat. No. 4,190,930 the sash rests on a sloping surfaced shoe that is at the end of the cord that extends out of the bottom of the balance assembly housing, or on a sloping boss that extends laterally from the bottom of the housing.

Wood, U.S. Pat. No. 4,068,406 describes a block and tackle in which the sash pivots on a brake shoe that hangs from the end of the cord that extends out of the bottom of the balance assembly housing.

SUMMARY OF THE INVENTION

It is one object of the invention to provide a sash balance shoe which contains in the shoe, a block and tackle and a spring attached to the block and tackle and to the shoe.

It is another object of the invention to provide a sash balance shoe which contains in the shoe, a brake that locks against a window frame when the shoe is attached to a sash and the sash is rotated out of the window frame, a block and tackle, and a spring attached to the block and tackle and to the shoe housing.

Other objects and advantages of the invention will become apparent to persons skilled in the art from the ensuing description.

A sash balance shoe includes: a housing having a first end, a second end and a first length from the first end to the second end, the housing is adapted for moving along a second length of a window frame track, the first length parallel to the second length, an elastic element having a second end attached to the housing against movement in the housing along the first length, and having a third end attached to a first pulley block that is movable in the housing along the first length, a second pulley block mounted in the housing fixed against movement in the housing along the first length, spaced from the first pulley block, a cam mounted in the second pulley block, rotatable about a first axis in response to rotation of the sash out of the window frame when the cam is connected to the sash, a cord having a first end attached to one of the first pulley block and the second pulley block, wrapped around a first pulley in the first pulley block, wrapped around a second pulley in the second pulley block, extending from the housing for attachment of a second end of the cord to the window frame when the housing is mounted on the track for movement along the track.

The sash balance shoe further includes the housing including a front wall, a first side wall attached to the front wall and a second side wall attached to the front wall, extending generally U-shape in cross section on three sides of each of the elastic element, the first pulley block and the second pulley block, means for connecting the cam to the sash extending along the first axis generally normal to the front wall, traversing the front wall, so that when the housing is mounted on the track for moving along the second length, and the means for connecting is attached to the sash, the elastic element, first pulley block and at least a portion of the second pulley block are enclosed by the housing and the track when the sash is parallel to the track and when the sash is rotated out of the window frame, and means for guiding the housing in the track integrally molded on the second pulley block extending laterally to the first length.

Provisional Application No. 60/449,048 filed Feb. 21, 2003 is hereby incorporated herein in its entirety by reference.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
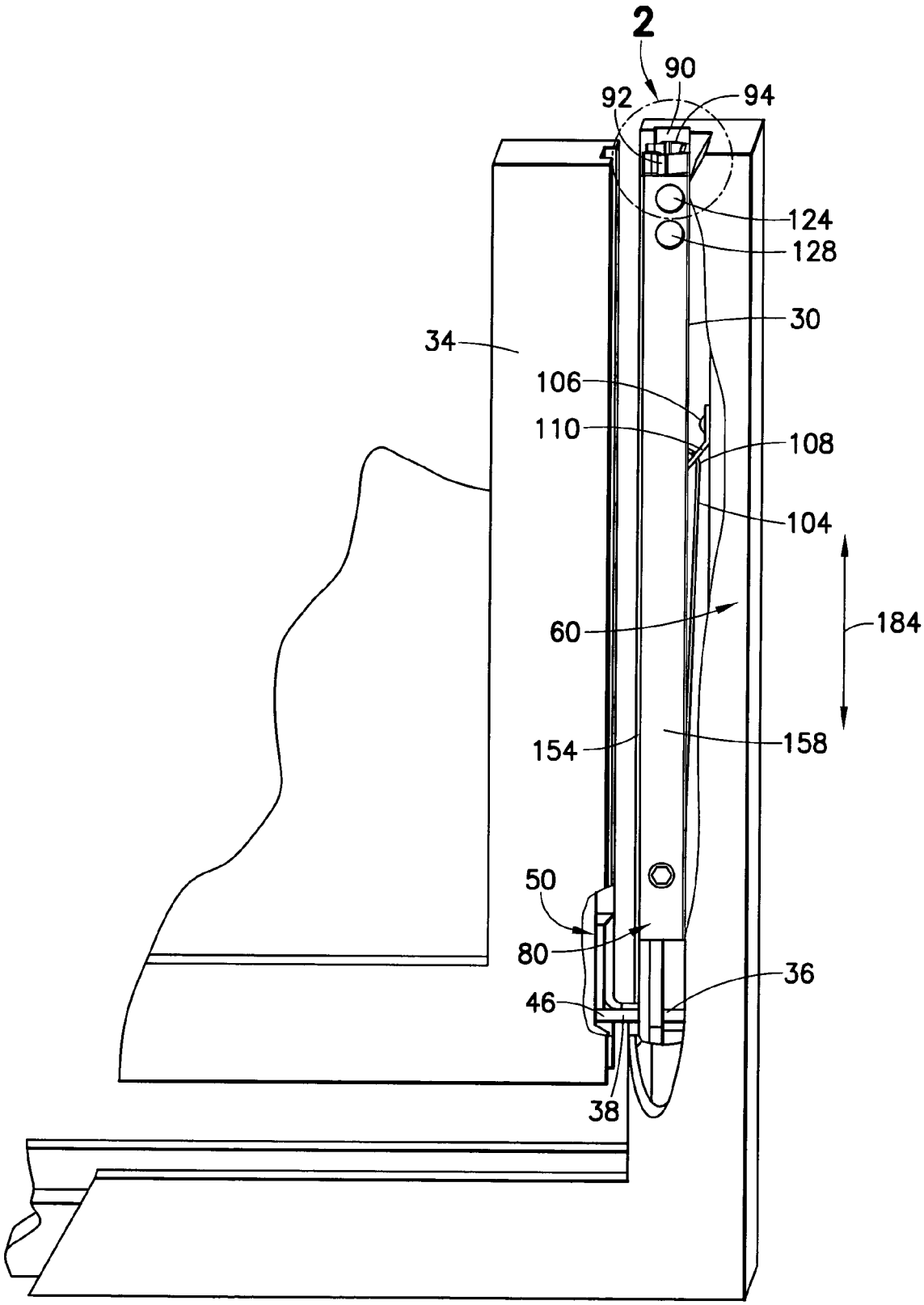
FIG. 1 is a schematic side view of a sash balance shoe according to the invention, slidingly mounted in a track in a window frame, attached to a sash by a pivot arm. The brake is omitted so that the pivot shaft of the arm can be seen.
Figure 5:
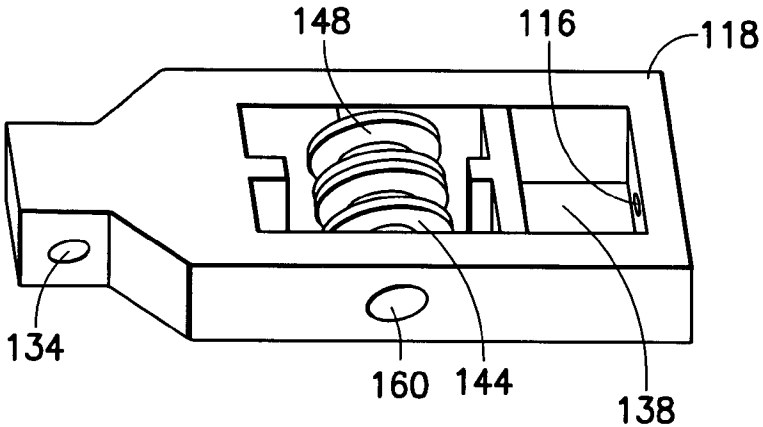
FIG. 5 is a perspective view of a movable block of the block and tackle within the housing of the sash balance shoe of FIG. 4.
Figure 2:
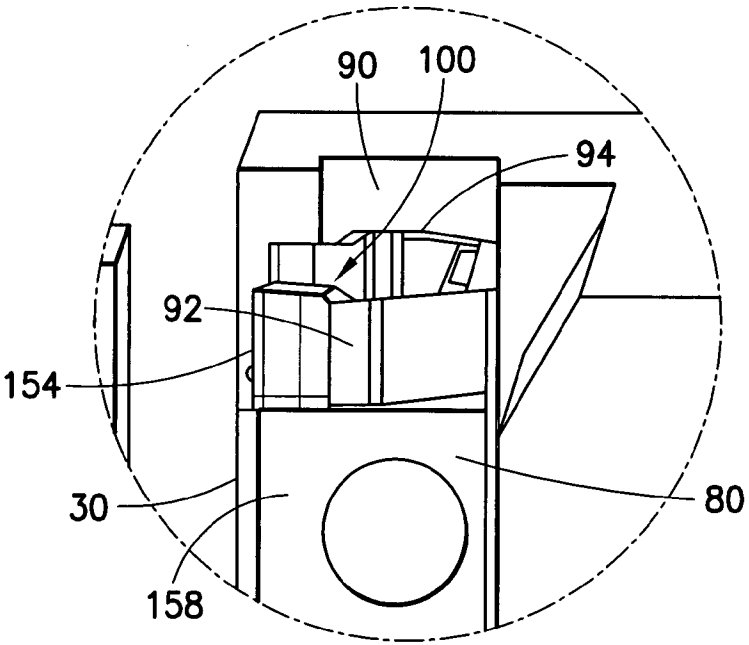
FIG. 2 is an enlarged view of a slide guide of the sash balance shoe of FIG. 1, in the track of the window frame, viewed along 2—2.
Figure 3:
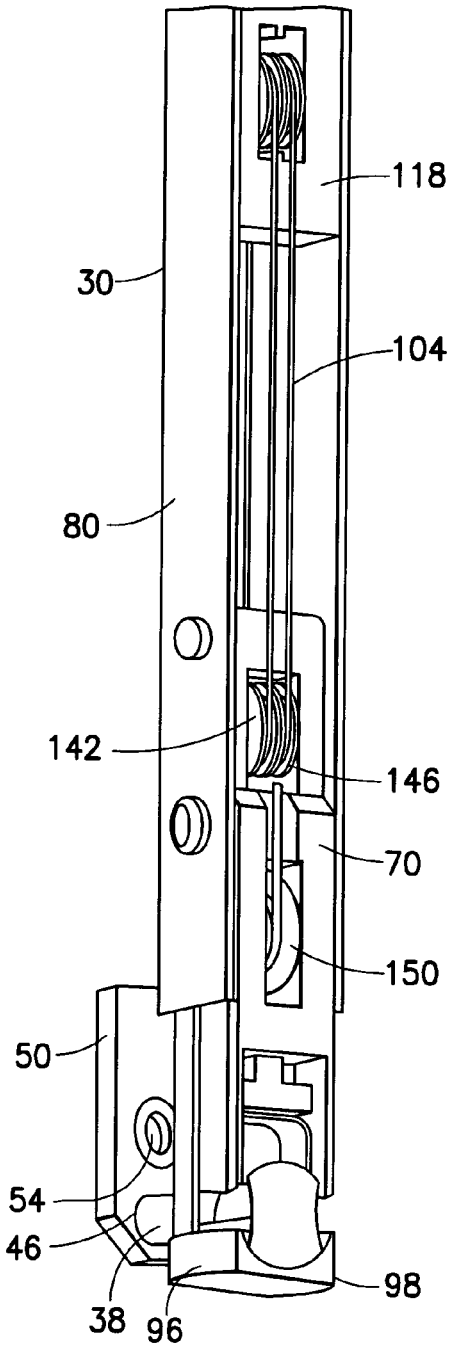
FIG. 3 is a schematic back perspective view of the sash balance shoe of FIG. 1, including the pivot arm.
Figure 4:
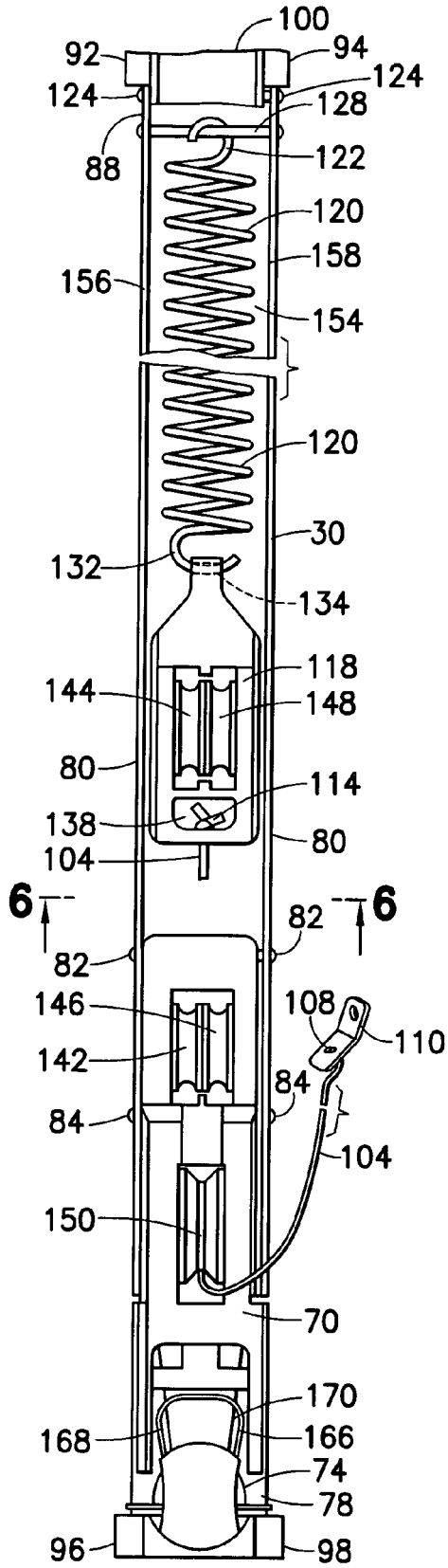
FIG. 4 is a schematic back view of the balance shoe of FIG. 1.
Figure 6:
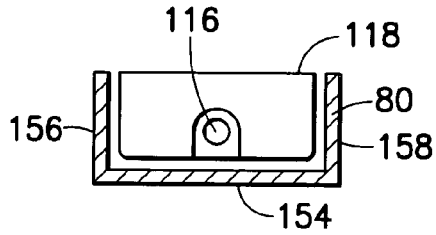
FIG. 6 is a cross section view of FIG. 4 taken along 6—6.
Figure 7:
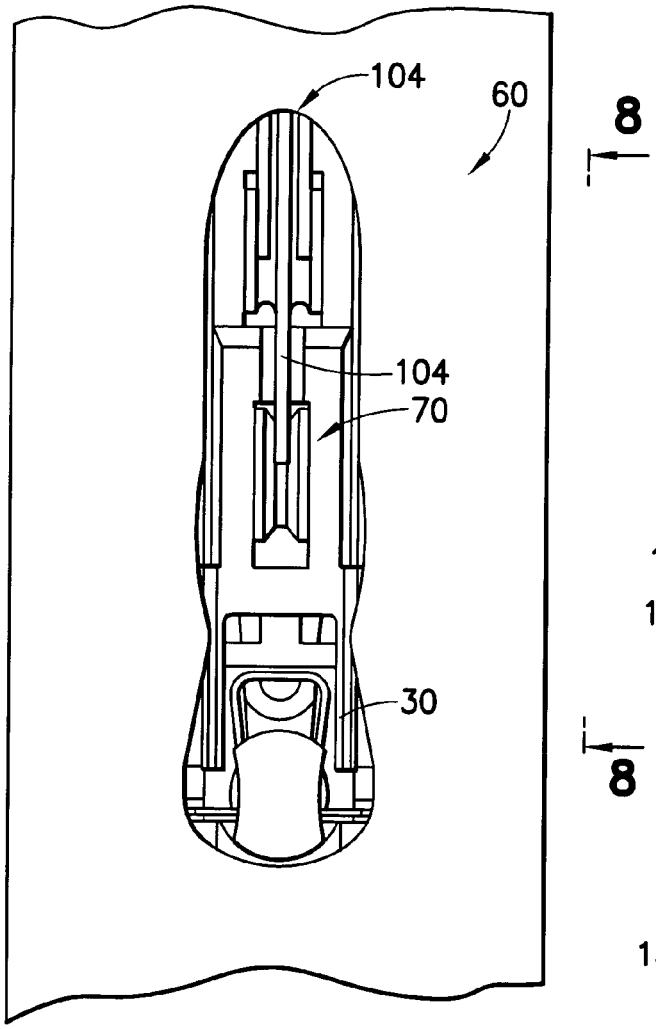
FIG. 7 is a back view of the fixed block of the sash balance shoe of FIG. 4 viewed through a cut-away portion of the window frame and track.
Figure 8:
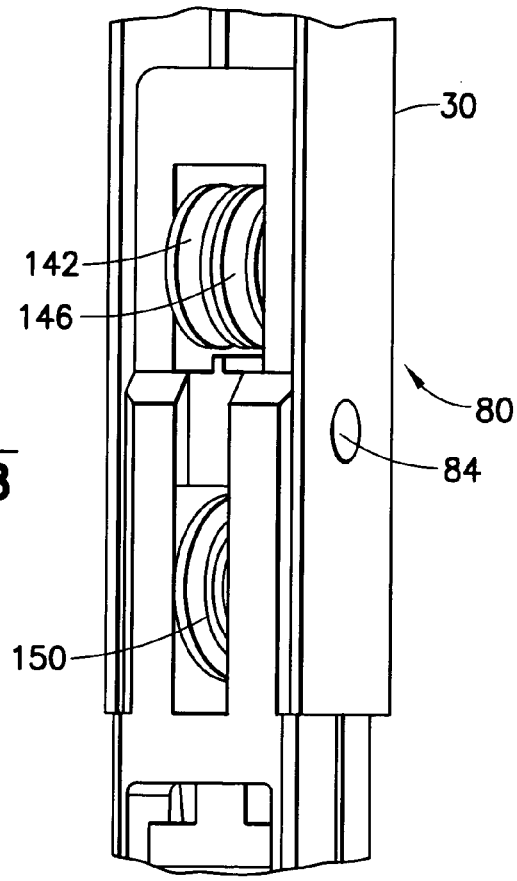
FIG. 8 is an enlarged perspective view of the fixed block of FIG. 7 viewed along 8—8.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–17, sash balance shoe 30 is connected to, and supports part of the weight of sash 34 by end 36 of pivot bar 38 which extends into and circumferentially closely fits slot 40 of rotary cam 42.

End 46 of pivot bar 38 is attached to pivot arm 50 which is fastened to sash 34 by a screw through hole 54 so that when the sash is pivoted out of window frame 60 on pivot arm 50, say into a room, the sash rotates pivot arm 50 which rotates cam 42 by way of slot 40.

Cam 42 transfers weight of sash 34 to pulley block 70 rotational bearing surface 74 which is integrally molded with block 70. Bearing surface 74 is in brake housing 78 which is a portion of block 70. Bearing surface 74 supports cam 42.

Block 70 is preferably molded of plastic.

Pulley block 70 is mounted in elongated housing 80 which is U-shaped in cross section. Block 70 is fastened to housing 80 by pins 82 and 84 through holes 83, 85 in the block and through sides 156, 158 of housing 80. Preferably housing 80 is stamped and formed from steel sheet, and is plated against rust.

Housing 80 slides vertically in track 90 on guides 92 and 94 of guide insert 100, and guides 96, 98 integrally molded on the body of pulley block 70.

Guide insert 100 mounts in end 88 of housing 80 by inserting base 102 into the housing and inserting pin 124 through hole 126 in the base and walls 156, 158 of the housing.

Cord 104 end 108 is fastened by screw 106 through bracket 110 to window frame 60 so that weight of sash 34 is supported by end 108 of the cord.

The other end, 114 of cord 104 which extends through hole 116 is attached to pulley block 118 which is slidably mounted in housing 80. Block 118 is preferably molded of plastic.

The pulleys in the blocks are preferably mounted in the blocks on axles 160, 162, 164 after the blocks are molded. Preferably the axles are metal.

Tension spring 120 end 122 is hooked around pin 128 which is fixed to housing 80.

End 132 of the spring is hooked through hole 134 in block 118.

Cord 104 can be strung starting from end 114 as follows:

Starting from a knot in cavity 138, through hole 134, around pulley 142 from front to back of balance shoe 30, around pulley 144 from back to front of balance shoe 30, around pulley 146 from front to back, around pulley 148 from back to front, around the front of pulley 150 and over the back of pulley 150 as far as the pulley accommodates cord 104 extending parallel to the length of housing 80 to where end 108 of the cord is attached to window frame 60.

Front wall 154 and side walls 156, 158 of housing 80 conceals view of spring 120, and the pulleys and cord 104 from view when sash balance shoe 30 is in track 90 at all rotated positions of the sash from parallel to the window frame to one end of the sash being rotated out of the window frame.

Figure 11:
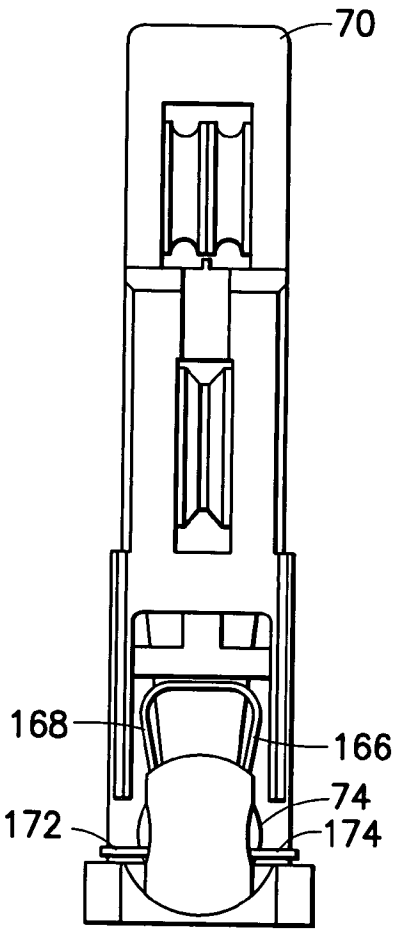
FIG. 11 is a back view of the fixed block of FIG. 9
Figure 10:
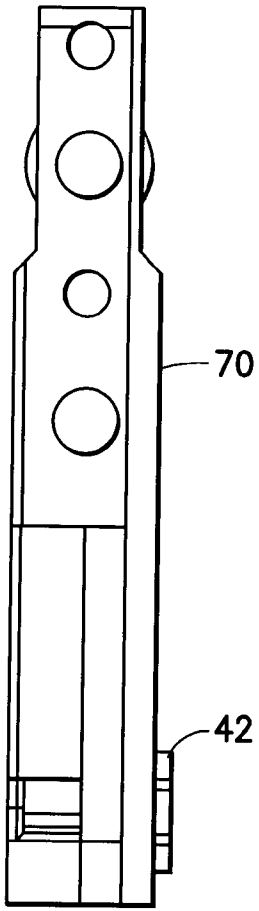
FIG. 10 is a side view of the fixed block of FIG. 9.
Figure 9:
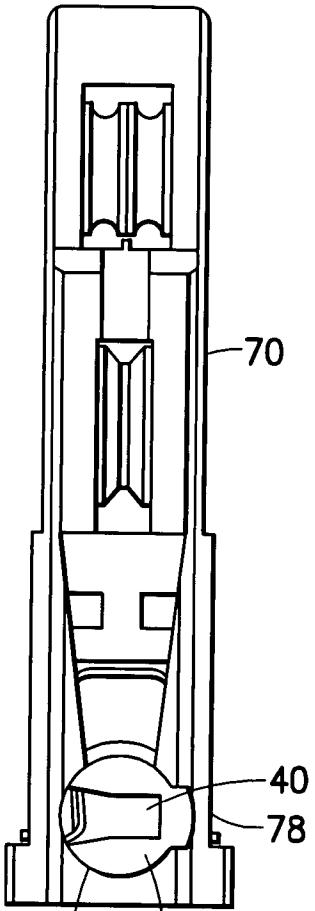
FIG. 9 is a front view of the fixed block of FIG. 4 in which the brake shaft slot is rotated to a non-tilted window position.
Figure 13:
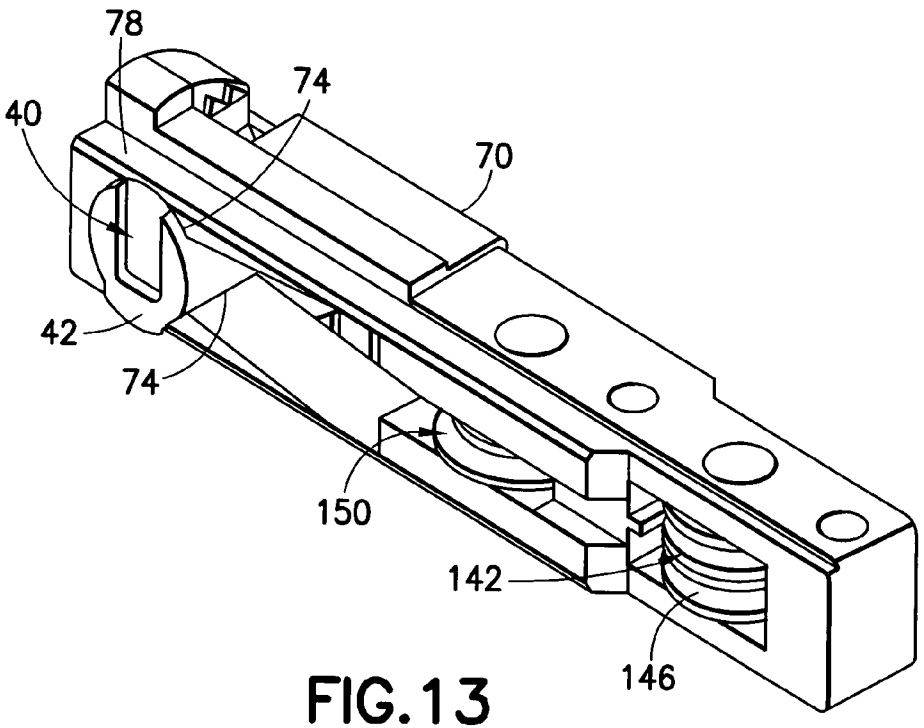
FIG. 13 is an isometric front and side view of the fixed block of FIG. 9.
Figure 12:
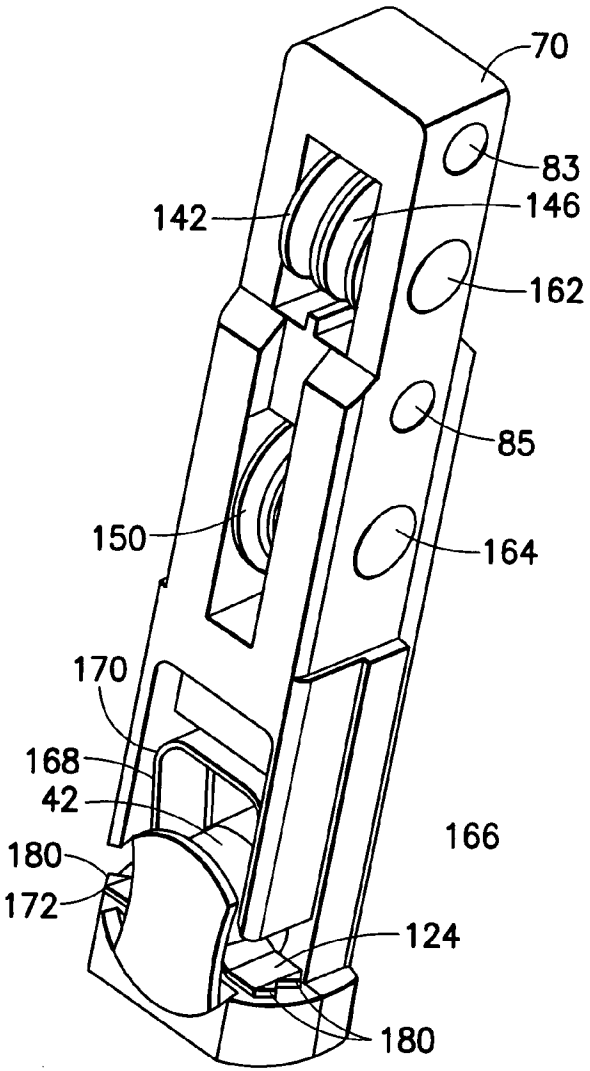
FIG. 12 is a perspective view of the fixed block of FIG. 9
Figure 14:
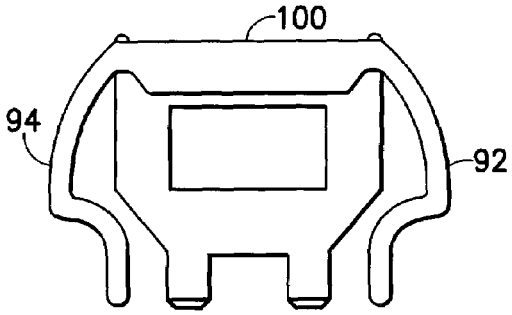
FIG. 14 is a top view of the slide guide of FIG. 2.
Figure 15:
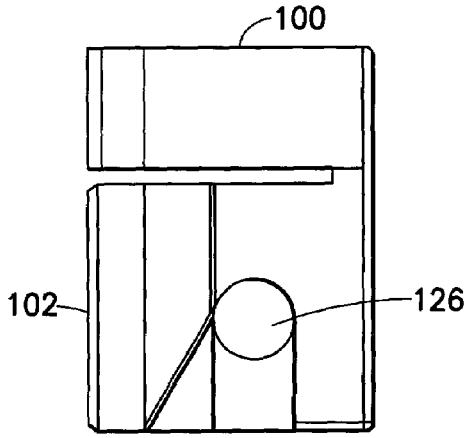
FIG. 15 is a side view of the slide guide of FIG. 14.
Figure 16:
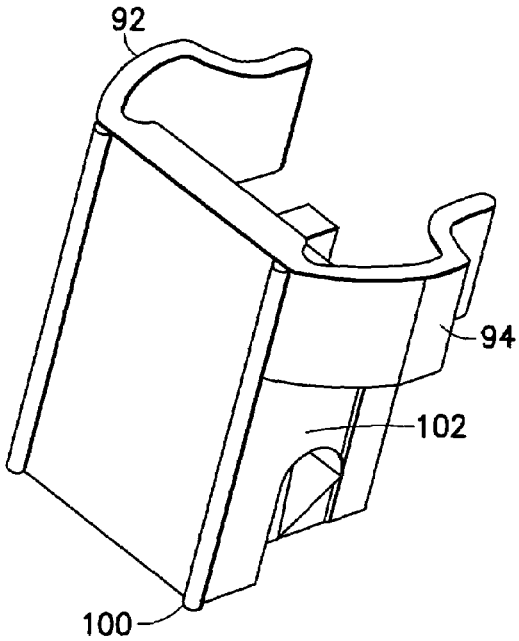
FIG. 16 is a back perspective view of the slide guide of FIG. 14.
Figure 17:
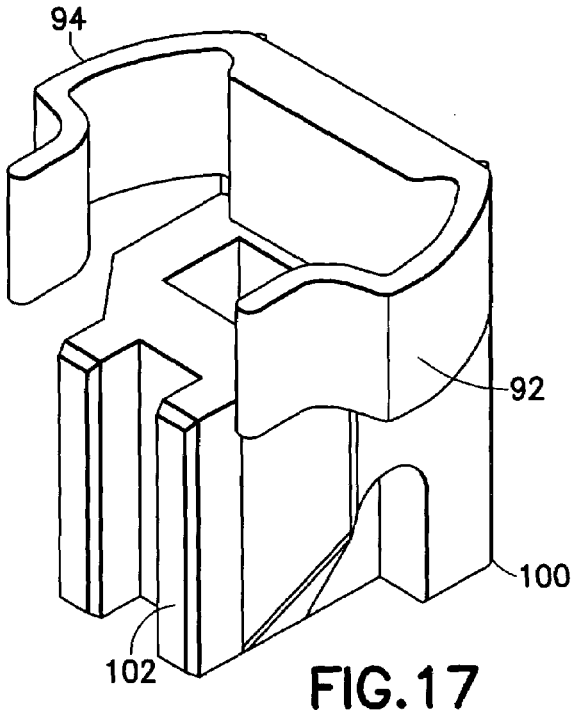
FIG. 17 is a front and side perspective view of the slide guide of FIG. 14.

When cam 42 is rotated to the position at which the sash is tilted out of the frame, the cam forces apart legs 166, 168 of spring 170 Legs 166, 168 end respectively in radial feet 172, 174 which are withdrawn in FIG. 11. When slot 40 is rotated 90 degrees from the position of FIG. 9, block 70 brakes against movement along the track. Feet 172, 174 are forced radially outward so that points 180 of the feet bite into the track, preventing movement of sash balance shoe 30 lengthwise 184 along the track.

Figure 18:
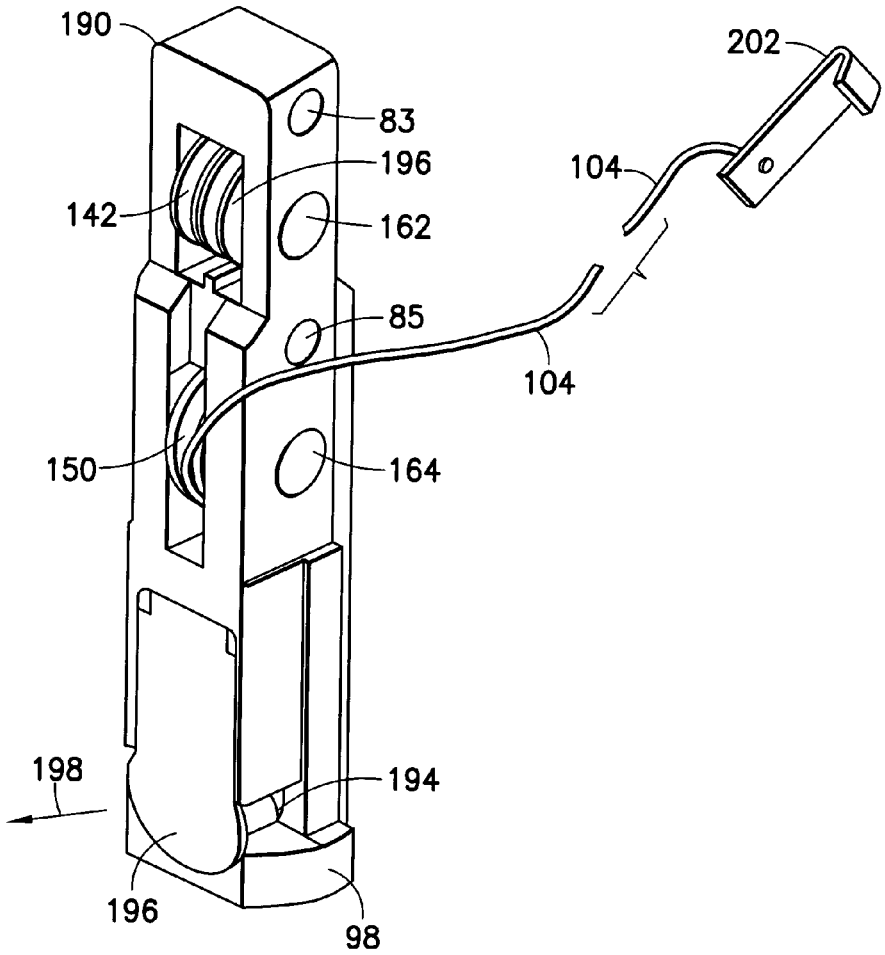
FIG. 18 is a back perspective view of another fixed pulley block of the invention.

In FIG. 18, pulley block 190 can be mounted in a housing 80 of the sash balance shoe of the invention by pins 82, 84 through holes 83, 85 like block 70 is mounted in housing 80. When cam 194 is rotated to a sash out of frame position, the cam forces plastic brake pad 196 axially outward 198 so that the pad presses against window frame 60 when block 190 is in track 90, preventing movement of the sash balance shoe lengthwise along the track.

Cord 104 is attached to the window frame by hook 202.

Figure 19:
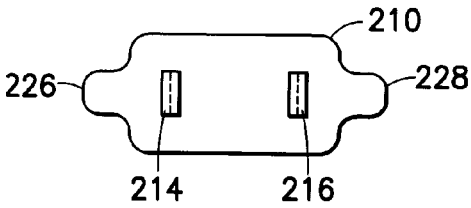
FIG. 19 is a bottom view of a guide insert of the invention.
Figure 20:
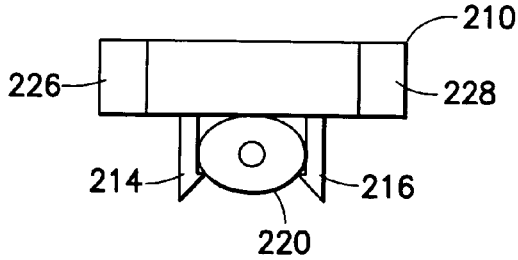
FIG. 20 is a side view of the guide insert of FIG. 19.

Referring to FIGS. 19 and 20, guide insert 210 is designed to mount in end 88 of housing 80, held in by flexible fingers 214, 216 around cylinder 220 which fits on pin 124. When insert 210 is mounted in housing 80, housing 80 is guided in the track by guides 226, 228.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (Informal List)

30 sash balance shoe
34 sash
36 end of pivot bar
38 pivot bar
40 slot
42 cam
46 end of pivot bar
50 pivot arm
54 hole
60 window frame
70 pulley block
74 bearing, rotational
78 brake housing
80 housing, elongated
82 pin
83 hole in block 70
84 pin
85 hole in block 70
88 end of housing 80
90 track
92 guide
94 guide
96 guide
98 guide
100 guide, insert
102 base
104 cord
106 screw
108 end of cord 104
110 bracket
114 end of cord 104
116 hole

118 pulley block
120 tension spring
122 end of tension spring 120
124 pin
126 hole
128 pin
132 end of tension spring 120
134 hole in block 118
138 cavity
142 pulley
144 pulley
146 pulley
148 pulley
150 pulley
154 front wall of housing 80
156 side wall of housing 80
158 side wall of housing 80
160 axle
162 axle
164 axle
166 leg
168 leg
170 spring
172 radial foot
174 radial foot
180 points
184 lengthwise
190 pulley block
194 cam
196 brake pad
198 axially outward
202 hook
210 guide insert
214 flexible finger
216 flexible finger
220 cylinder
226 guide
228 guide

What is claimed is:

1. A sash balance shoe comprising:

a housing having a first length, adapted for moving along a second length of a window frame track positioned in a window frame, wherein paid housing is integral to said window frame and not integral to the sash, a first elastic element comprising a first end attached to said housing against movement in said housing along the first length, and a second end attached to a first pulley block that is movable in said housing along said first length, a second pulley block mounted in said housing fixed against movement in said housing along said first length, spaced from said first pulley block, a second element mounted in said second pulley block, rotatable about a first axis through said second pulley block by rotation of the sash out of the window frame when said second element is connected to the sash and the housing is mounted on the track, a cord operatively connected with said first and second pulley blocks, and a means for braking, configured for lateral extension from said second pulley block in response to rotation of said second element for engaging the frame for, preventing movement of said housing along the second length of the window frame track.

2. The sash balance shoe of claim 1 further comprising:

a bearing surface in said second pulley block for receiving said second element for rotation of said second element on said first axis.

3. The sash balance shoe of claim 1 further comprising:

a bearing surface integrally molded with said second pulley block, for receiving said second element for rotation of said second element on said first axis.

4. The sash balance shoe of claim 1 further comprising:

said housing comprising a front wall, a first side wall attached to said front wall and a second side wall attached to said front wall, extending generally U-shape in cross section on three sides of each of said elastic element, said first pulley block and said second pulley block, means for connecting said second element to the sash extending from said second element along said first axis generally normal to said front wall so that when said housing is mounted on said window frame track for moving along the second length, and said means for connecting a attached to the sash, an open side of said housing opposite to the front wall is covered by he track.

5. The sash balance shoe of claim 1 further comprising:

said housing comprising a front wall, a first side wall attached to said front wall and a second side wall attached to said front wall, extending generally U-shape in cross section on three sides of each of said elastic element, said first pulley block and said second pulley block, means for connecting said second element to the sash, extending along said first axis generally normal to said front wall, traversing said front wall, so that when said housing is mounted or the track for moving along the second length and said means for connecting is attached to the sash, the elastic element, first pulley block, and at least a portion of the second pulley block are enclosed by said housing and the track when the sash is parallel to the track and when the sash is rotated out of the window frame.

6. The sash balance shoe of claim 1 further comprising:

means for guiding said housing in said track integrally molded on said second pulley block extending laterally to the first length.

7. A sash balance shoe comprising:

a housing having a first end, a second end and a first length from said first end to said second end, adapted for moving along a second length of a window frame track positioned in a window frame, the first length parallel to the second length, wherein said housing is integral to said window frame and not integral to the sash, an elastic element having a first end attached to the housing against movement in said housing along said first length, and having a second end attached to a first pulley block that is movable in said housing along said first length, a second pulley block mounted in said housing fixed against movement in said housing along said first length, spaced from said first pulley block, a cam mounted in said second pulley block, rotatable about a first axis in response to rotation of the sash out of the window frame when said cam is connected to the sash, a cord having a first end attached to one of said first pulley block and said second pulley block, wrapped around a first pulley in said first pulley block, wrapped around a second pulley in said second pulley block, extending from said housing for attachment of a second end of said cord to the window frame when said housing is mounted on the track for movement along the track.

8. The sash balance shoe of claim 7 further comprising:

said housing comprising a front wall, a first side wall attached to said front wall and a second side wall attached to said front wall, extending generally U-shape in cross section on three sides of each of said elastic clement said first pulley block and said second pulley block, means far connecting said cam to the sash extending along said first axis generally normal to said front wall, traversing said front wall, so tat when said housing is mounted on the track for moving along the second length, and said means for connecting is attached to the sash, the elastic element, first pulley block and at least a portion of said second pulley block are enclosed by said housing and the track when the sash is parallel to the track and when the sash is rotated out of the window frame.

9. The sash balance shoe of claim 8 further comprising:

means for guiding said housing in said track integrally molded on said second pulley block extending laterally to the first length.

* * * * *